US005729926A

United States Patent [19]

Cowgill et al.

[11] Patent Number: 5,729,926

[45] Date of Patent: Mar. 24, 1998

[54] ROLL-UP SIGN WITH REMOVABLE BATTEN

[75] Inventors: John H. Cowgill, Otis; Charles W. Elroy, Jr., Depoe Bay, both of Oreg.

[73] Assignee: Sportniks, Inc., Depoe Bay, Oreg.

[21] Appl. No.: 634,553

[22] Filed: Apr. 18, 1996

Related U.S. Application Data

[63] Continuation-in-part of Ser. No. 337,896, Nov. 14, 1994, Pat. No. 5,551,177, which is a continuation-in-part of Ser. No. 252,232, Jun. 1, 1994, Pat. No. 5,598,654.

[51] Int. Cl.[6] ..... G09F 15/00

[52] U.S. Cl. ..... 40/610; 40/586; 40/612; 116/63 P; 116/173; 160/377; 404/9

[58] Field of Search ..... 40/610, 612, 586, 40/604; 404/6, 9, 10; 116/173, 63 P; 160/377

[56] References Cited

U.S. PATENT DOCUMENTS

| | | | |
|---|---|---|---|
| 403,698 | 5/1889 | Rector | 40/586 |
| 2,732,823 | 1/1956 | Hanson | 116/173 |
| 2,819,547 | 1/1958 | Clements, Jr. | 40/612 |
| 2,887,983 | 5/1959 | Budd | 116/63 P |
| 3,200,786 | 8/1965 | Swezy et al. | 40/610 X |
| 3,526,200 | 9/1970 | Doyle | 116/173 X |
| 3,581,420 | 6/1971 | Mollet, III et al. | 40/604 |
| 3,775,887 | 12/1973 | Precourt . | |
| 3,800,730 | 4/1974 | Taylor . | |
| 3,847,335 | 11/1974 | Ross . | |
| 3,922,998 | 12/1975 | May | 116/63 P X |
| 4,071,969 | 2/1978 | Tonhäuser | 40/610 |
| 4,103,445 | 8/1978 | Smith et al. | 40/610 X |
| 4,152,854 | 5/1979 | Berry, Jr. et al. | 40/610 |
| 4,209,927 | 7/1980 | Donatelle | 40/607 |
| 4,490,934 | 1/1985 | Knapp | 40/610 X |
| 4,541,190 | 9/1985 | Weiner et al. | 40/610 |
| 4,619,220 | 10/1986 | Seely et al. | 116/173 X |
| 4,759,606 | 7/1988 | McDowell | 404/6 X |
| 4,817,319 | 4/1989 | Vitale | 40/610 |
| 4,866,866 | 9/1989 | Rotter et al. | 40/610 |
| 4,875,302 | 10/1989 | Noffsinger | 40/610 |
| 4,876,811 | 10/1989 | Peltz | 40/586 |
| 4,980,984 | 1/1991 | Kulp et al. | 40/610 |
| 4,982,683 | 1/1991 | Earnest, Jr. | 116/63 P |
| 4,986,016 | 1/1991 | Wichman | 40/610 |
| 5,001,455 | 3/1991 | Starchevich | 40/586 X |
| 5,003,716 | 4/1991 | Dyar | 40/503 |
| 5,016,372 | 5/1991 | Gold | 40/604 X |
| 5,115,623 | 5/1992 | Ahlberg | 40/610 X |
| 5,125,205 | 6/1992 | Wichman | 40/610 X |
| 5,152,091 | 10/1992 | Leach | 40/603 |
| 5,175,646 | 12/1992 | Eden | 40/610 X |
| 5,197,408 | 3/1993 | Stoudt | 116/173 |
| 5,231,778 | 8/1993 | Belobraydich et al. | 40/610 |
| 5,276,424 | 1/1994 | Hegemann | 40/586 X |
| 5,792,258 | 12/1988 | Goff | 404/6 |

FOREIGN PATENT DOCUMENTS

| | | | |
|---|---|---|---|
| 11527 | 1/1907 | United Kingdom | 116/173 |

*Primary Examiner*—Brian K. Green
*Assistant Examiner*—Andrea Chop
*Attorney, Agent, or Firm*—Robert D. Varitz

[57] ABSTRACT

A sign includes a frame having plural battens therein. A web is disposed over the frame. The web has opposed, co-extensive sides which form a pocket therebetween. The frame is located inside the pocket of the web. A support for the sign is provided which is attached to at least one of the frame battens and is contiguous therewith. At least one of the frame battens is fixed to the web and at least one of the frame battens is removable from the web.

18 Claims, 1 Drawing Sheet

ROLL-UP SIGN WITH REMOVABLE BATTEN

RELATED APPLICATION

This is a Continuation-in-Part of U.S. patent application Ser. No. 08/337,896, filed Nov. 14, 1994, now U.S. Pat. No. 5,551,177, granted Sep. 3, 1996, which is a Continuation-in-Part of U.S. patent application Ser. No. 08/252,232, filed Jun. 1, 1994, now U.S. Pat. No. 5,598,654, granted Feb. 4, 1997.

TECHNICAL FIELD

This invention relates to signs and more particularly to a sign which may be collapsed and rolled up for easy storage and transportation.

BACKGROUND ART

Temporary signs are in use worldwide. Such signs are used to provide direction for traffic, to provide notice that property is for sale or lease, or to provide any other type of information to the passer by. Because of the temporary nature of such signs, it is necessary that they be transportable with a minimum amount of effort and inconvenience. To this end, a large variety of collapsible and/or folding signs have been developed.

In the field of highway signs, one such sign is disclosed in U.S. Pat. No. 5,152,091 to Leach. This sign utilizes a fabric web over a metal frame having a pair of arms which are pivoted at their midpoints. Once the arms are extended, the fabric web is stretched over the frame and secured to the ends of the arms. This sign is then placed in a stand which provides support therefor.

Ross, U.S. Pat. No. 3,847,335 discloses a folding portable sign standard which again has a pair of mutually-pivoting supports for the sign and a base, all of which may be folded into a relatively compact structure suitable for transportation and storage.

U.S. Pat. No. 4,541,190 to Weiner et al discloses a folding sign which may have a variety of messages or instructions printed thereon, and which folds to a compact state for storage and transportation.

Culp et al, U.S. Pat. No. 4,980,984 discloses yet another type of sign which may have its framework folded up and encased within the message-bearing web for transportation and storage.

Other forms of collapsible signs are disclosed in U.S. Pat. No. 4,875,302 to Knoffsigner, which discloses a foldable frame and a web stretched there over, wherein the web forms a backing to which a sign may be attached.

U.S. Pat. No. 4,817,319 to Vitale and U.S. Pat. No. 4,866,866 to Rotter et al both disclose signs which may be collapsed and which may be sunk into the ground to provide various types of notices.

Another type of sign that is frequently seen along the highways is the STOP/SLOW sign used by highway workers to control traffic through a construction area. Such a sign is typically nothing more than a conventional, metal 18- or 24-inch wide octagonal "STOP" sign, as is used at fixed stop sign locations, with a "SLOW" warning on the reverse side thereof. The sign may be turned side-for-side depending on whether the highway worker desires oncoming traffic to stop or to merely proceed at a slower pace. Such signs generally have a supporting handle thereon, which is grasped by the highway worker, or may be mounted on a pole which is rested on the ground. As may be expected, such a sign is usually quite heavy, particularly if it is required to be held for some time by a highway worker.

One of the problems associated with temporary signs occurs during inclement weather conditions, particularly during high winds. Temporary signs will often be rotated or hocked over by the wind, or, if the flexible web over a temporary sign is not properly supported, the web will billow, thereby producing an air foil which further aggravates the problem which may cause the sign to "kite." Another weather-related problem occurs during rainy weather—which can always include a lightning storm. A working holding a metal sign in a lightning storm is at risk of turning into a lightning rod. The worker may not always have the option of seeking cover during such weather, and may have to remain exposed to the elements.

One of the disadvantages of known collapsible signs is that the web is generally detached from the sign for storage purposes. Thus, the web over the sign is constantly being removed and applied to the framework, thereby causing wear on the web and inconvenience to the workers who are placing the sign, as additional steps are required in order to ready the sign for use.

DISCLOSURE OF THE INVENTION

The sign of the invention includes a frame having plural battens therein. A web is disposed over the frame. The web has opposed, co-extensive sides which form a pocket therebetween. The frame is located inside the pocket of the web. A support for the sign is provided which is attached to at least one of the frame battens and is contiguous therewith. At least one of the frame battens is fixed to the web and at least one of the frame battens is removable from the web.

An object of the invention to provide a sign which may be easily collapsed, as by rolling it up for storage and transportation.

Another object of the invention is to provide a sign which is lightweight and easily handled by a worker.

A further object of the invention is to provide a sign which includes a web disposed over a collapsible frame, wherein at least a part of the frame is permanently secured to the web. Another object of the invention is to provide a sign which is essentially non-metallic.

These and other objects and advantages of the invention will become more fully appreciated as the description which follows is read in connection with the drawings.

BEST MODES FOR CARRYING OUT THE INVENTION

Figure 1:
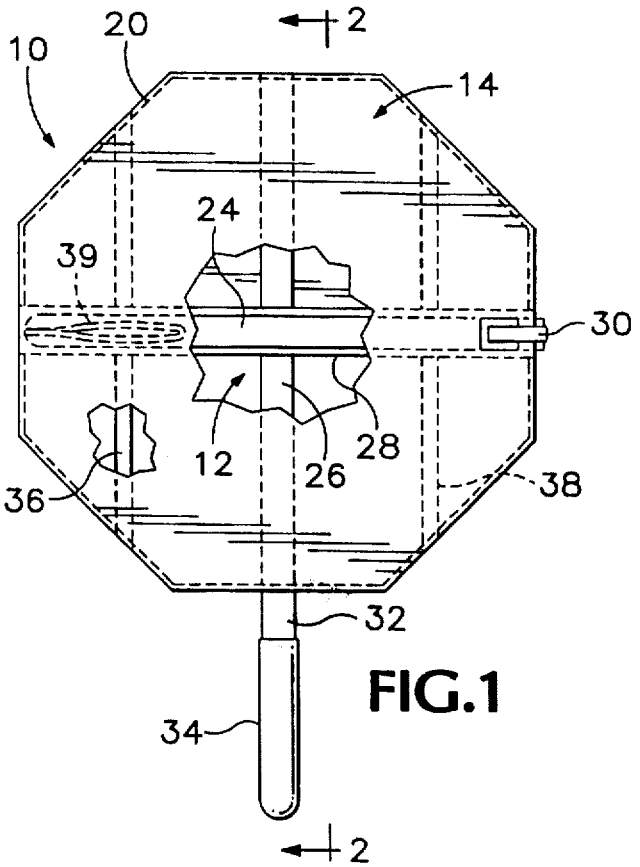
FIG. 1 is a front elevation of a first embodiment of the sign constructed according to the invention.
Figure 2:
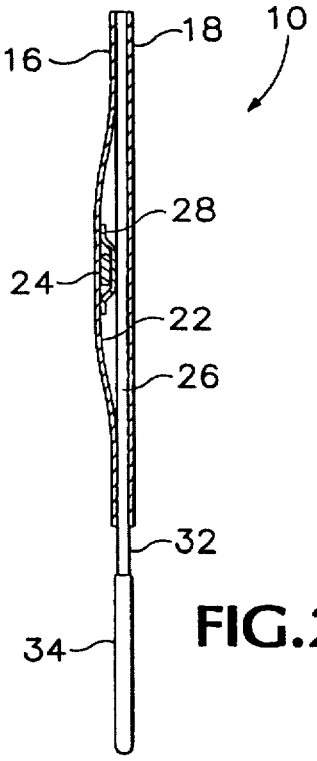
FIG. 2 is a side elevation of the sign of the invention, taken generally along the line 2—2 of FIG. 1, having an exaggerated midsection therein.

Turning initially to FIGS. 1 and 2, a sign constructed according to the invention is depicted generally at 10. Sign 10 includes a frame 12 having a web 14 disposed thereover.

Web 14 includes a pair of opposed, co-extensive sides, designated as first web side 16 and second web side 18. Sides 16 and 18 are joined to one another along a majority of their periphery, and in the preferred embodiment, are joined to one another about their entire periphery, except where portions of the frame extend through the web. Such joining is accomplished by means of stitching, as represented at 20, although the sides may also be glued or heat-sealed together. A pocket 22 is formed between the sides of web 14, which pocket entirely encompasses frame 12 therein.

The material forming the sides of web 14 may be reflective, and may contain indicia or lettering thereon, such as the familiar "STOP" notation which would appear on one side of sign, and which would be formed in the conventional white letters on a red background. The other side of the web may be provided with an orange background and black letters for the word "SLOW." The fabric of the web may be reflective. One material which has been found to be particularly suited for the web is a 3-M® product, identified by product nos. 8986 and 8987, which is Scotch-lite™ reflective fabric in red-orange, and lime-yellow, respectively. The 3-M® product has reflective, wide-angle lenses bonded to a cloth backing. The colors are conspicuous under daylight conditions and are exceptionally reflective at night. The fabric has reflectivity values of approximately 175 foot candles per square foot of material. Another 3-M® product which is identified as Scotch-lite™ reflective fabric 8960, in white, is also suitable, for use on the sign, particularly for providing lettering on signs constructed according to the invention. This product provides a reflectivity of 70–100 foot candles per square foot of fabric. The fabric selected for web 14 is a non-electrically conductive material, and is lightweight.

As previously noted, web 14 includes a pocket 22 therein. As depicted in FIG. 1, pocket 22 is completely enclosed by stitching 20 about its periphery, except for that portion of the periphery which is adjacent a first frame batten 24. Frame 12 also includes a second frame batten 26. In the preferred embodiment, battens 24 and 26 are placed normal to one another within web 14. Frame batten 24 is removable from web 14 to allow collapsing of the web about frame batten 26. In the preferred embodiment, frame batten 24 is received within a sleeve 28 which is fastened to the interior side of first web side 16. A fastener 30 is provided to secure frame batten 24 to web 14. Fastener 30 may take any of several forms, including snaps, hook-and-loop fasteners, or an eye-and-hook structure. Placement of batten 24 in sleeve 28 isolates it from batten 26, which prevents wear on the two battens, as would occur in the instance where the battens were in contact with one another within pocket 22.

A support 32 is provided for sign 10, and, in this embodiment, is attached to frame batten 26, and is contiguous therewith. A handle 34 is located on support 32 and provides a means for gripping sign 10 by a worker. Handle 34 may be provided with a receiver in the base thereof, so that the sign may be placed on a pole so that the worker does not have to manually support the sign for long periods of time.

Sign 10 includes stiffening battens 36 and 38, which, in the preferred embodiment, are secured to web 14 as by stitching between sides 16 and 18. The stiffening battens may also be fixed to web 14 by adhesive or heat-sealing. Stiffening battens 36, 38 are provided to provide rigidity to web 14. The stiffening battens are arranged parallel to the fixed batten, so that the web may be rolled up when the removable batten is removed.

The removable batten may be equipped with a lanyard, particularly, a stretchable lanyard 39, which may be used to secure the removable batten to the web when the web is rolled up. Lanyards may be provided at both ends of the removable batten so as to secure the removable batten to the rolled-up sign and to maintain the sign in a rolled-up condition.

Figure 3:
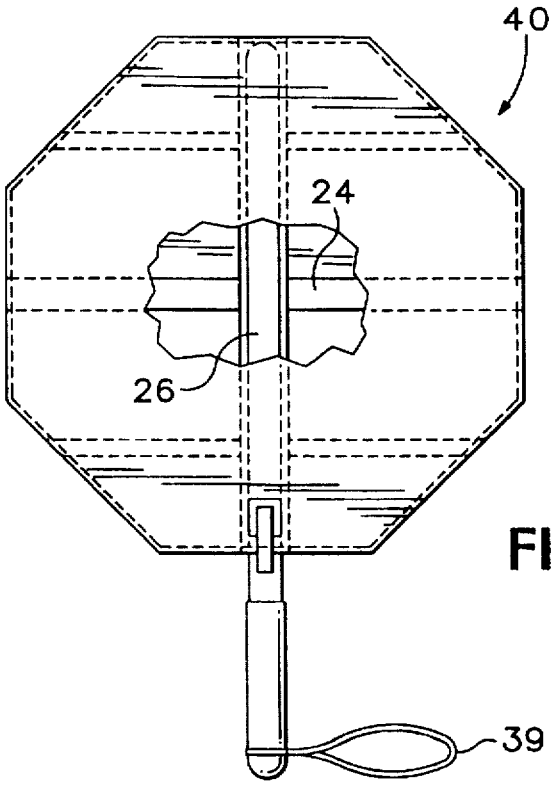
FIG. 3 is an alternate embodiment of the sign of the invention.

Referring now to FIG. 3, a second embodiment of the sign is depicted generally at 40. In this embodiment of the sign, frame batten 24 is fixed to web 14, while frame batten 26 is removable from sleeve 28. This embodiment is useful for those conditions in which it is helpful to have a longer removable batten, which may include means for securing the sign in a rolled up condition, such as lanyard 39.

Although two of embodiments of the invention have been described herein, it should be appreciated that yet further modifications may be made thereto without departing from the scope of the invention as defined in the appended claims.

INDUSTRIAL APPLICABILITY

The signs of the invention are particularly well suited for warning signs to be used in connection with highway construction. Additionally, the signs of the invention are particularly well suited where any temporary sign is required.

We claim:

1. A sign comprising:

a frame having plural frame battens;

a web disposed over said frame, said web having opposed, co-extensive sides forming a pocket therebetween, wherein said frame is located in said pocket of said web;

a sleeve fastened to one side of said web;

a support for the sign which is attached to at least one of said frame battens and is contiguous therewith; and wherein at least one of said frame battens is fixed to the web and at least one of said frame battens received in said sleeve and is removable from said web.

2. The sign of claim 1 wherein said sides of said web are joined to one another about a majority of their periphery.

3. The sign of claim 1 wherein said sides of said web are joined to one another about their entire periphery except where said frame batten that is removable extends through a side of said web.

4. The sign of claim 1 which includes a fastener to secure said frame batten that is removable from said web in said web.

5. The sign of claim 1 which includes stiffening battens located in said pocket and secured to said web.

6. A sign comprising:

a frame having plural frame battens, wherein said frame battens are arranged normal to one another;

a web disposed over said frame, said web having opposed, co-extensive sides forming a pocket therebetween, and a sleeve fastened to one side of said web within said pocket, wherein said frame is located in said pocket of said web;

a support for the sign which is attached to at least one of said frame battens and is contiguous therewith; and wherein at least one of said frame battens is fixed to the web and at least one of said frame battens is removable from said web, and is carried within said sleeve when in position in said web.

7. The sign of claim 6 wherein said sides of said web are joined to one another about their entire periphery except where said frame batten that is removable extends through a side of said web.

8. The sign of claim 6 which includes a fastener to secure said frame batten that is removable from said web in said web.

9. The sign of claim 6 which includes stiffening battens located in said pocket and secured to said web.

10. The sign of claim 6 wherein said frame batten which is contiguous with said support is the frame batten which is removable.

11. The sign of claim 6 wherein said frame batten which normal to said frame batten that is contiguous with said support is the frame batten which is removable.

12. A sign comprising:

a frame having plural frame battens, wherein said frame battens are arranged normal to one another;

a web disposed over said frame, said web having opposed, co-extensive sides forming a pocket therebetween, wherein said frame is located in said pocket of said web, and a sleeve fastened to one interior side of said web in said pocket for receiving one of said frame batten therein;

a support for the sign which is attached to at least one of said frame battens and is contiguous therewith; and wherein at least one of said frame battens is fixed to the web and at least one of said frame battens is removable from said web.

13. The sign of claim 12 whereto said sides of said web are joined to one another about their entire periphery except where said frame batten that is removable extends through a side of said web.

14. The sign of claim 12 which includes a fastener to secure said frame batten that is removable from said web in said web.

15. The sign of claim 12 wherein said fastener is of the hook-and-loop type.

16. The sign of claim 12 which includes stiffening battens located in said pocket and secured to said web.

17. The sign of claim 12 wherein said frame batten which is contiguous with said support is the frame batten which is removable.

18. The sign of claim 12 wherein said frame batten which normal to said frame batten that is contiguous with said support is the frame batten which is removable.

* * * * *